US006542711B2

(12) United States Patent
Matsunai

(10) Patent No.: US 6,542,711 B2
(45) Date of Patent: Apr. 1, 2003

(54) IMAGE FORMING APPARATUS AND METHOD IN WHICH CONVEYING SPEED OF MEDIUM IS SLOWER THAN PROCESS SPEED FOR FORMING AN IMAGE ON THE MEDIUM

(75) Inventor: Tomohiro Matsunai, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/989,120

(22) Filed: Nov. 21, 2001

(65) Prior Publication Data

US 2002/0067927 A1 Jun. 6, 2002

(30) Foreign Application Priority Data

Dec. 4, 2000 (JP) ..... 2000-368980

(51) Int. Cl.[7] ..... G03G 15/00
(52) U.S. Cl. ..... 399/322; 399/405
(58) Field of Search ..... 399/68, 322, 381, 399/397, 400, 405, 328; 271/161, 209, 207, 270, 272

(56) References Cited

U.S. PATENT DOCUMENTS 6,338,481 B1 * 1/2002 Maruchi ..... 271/209

FOREIGN PATENT DOCUMENTS

| | | | |
|---|---|---|---|
| JP | 62-211263 A | * | 9/1987 |
| JP | 4-55256 A | * | 2/1992 |
| JP | 2000-109275 | | 4/2000 |

* cited by examiner

*Primary Examiner*—Joan Pendegrass
(74) *Attorney, Agent, or Firm*—Foley & Lardner

(57) ABSTRACT

The image forming apparatus includes the image forming unit to form an image on the first surface of a medium, the guide member that is curved to become convex to the first surface of the medium that has passed through the image forming unit and the conveying mechanism to convey the medium that has an image formed in the image forming unit toward the discharge unit while making the medium curved along the guide member. Further, the image forming apparatus has a controller to control a conveying speed by the conveying mechanism at the downstream side from the guide member along the conveying direction of a medium so that it becomes slower than that at the upper streamside from the guide member.

5 Claims, 7 Drawing Sheets

IMAGE FORMING APPARATUS AND METHOD IN WHICH CONVEYING SPEED OF MEDIUM IS SLOWER THAN PROCESS SPEED FOR FORMING AN IMAGE ON THE MEDIUM

CROSS-REFERENCE TO RELATED APPLICATIONS

This application is based upon and claims the benefit of priority on the prior Japanese Application No. 2000-368980, filed on Dec. 4, 2000; the entire contents of which are incorporated herein by reference.

BACKGROUND OF THE INVENTION

1. Field of the Invention

The present invention relates to an image forming apparatus and an image forming method such as a copying machine, a printer, etc. for forming images on such a medium as paper, etc. and more particularly, to an image forming apparatus designed to discharge a medium with the surface having a formed image downward.

2. Description of the Related Art

Generally, on such an image forming apparatus as a copying machine, a printer, etc., a latent image is formed on an image carrier by supplying a developer to the latent image and developing it. This developer image is transferred on a paper and fixed thereon by heating and pressurizing the transferred developer image.

For example, an image forming apparatus to discharge a paper with a developer image fixed thereon by conveying it along a curved conveying path is known. On this type of image forming apparatus having a curved conveying path, there may be caused such a defect that the image forming surface with a developer image just formed contacts a guide member, etc. on the conveying path and a streak is produced on the image. For this reason, in order to prevent such the defective image forming as mentioned above, various devices have been made on this type of apparatus.

For example, a both side printer that was disclosed in Japanese Laid-Open Patent Publication No. 2000-109275 has a curved conveying path 200 connecting a printer unit 201 and a paper converting unit 202 as shown in FIG. 1. The printer unit 201 is composed of: a paper supply section 211 that sends one sheet of paper at a time, an aligning portion 212 that takes a timing, a photosensitive drum that attaches a toner to an image to actualize it, a transferring roller 214 that transfers an image formed on the photosensitive drum 213 on a paper, a fixing unit 215 that fixes the toner image transferred on a paper by pressurizing and heating it, and a paper guide 216 that guides a paper discharged from the fixing unit 215 toward the paper converting unit 202 through the conveying path 200. The paper converting unit 202 has a paper guide 221 that guides a paper being conveyed from the printer unit 201 along the conveying path 200, a conveying roller 222 that conveys the paper that is guided by the paper guide 221, and a reversing roller 223 that changes the paper conveying direction.

In this apparatus, in order to prevent the surface of a paper on which an image is formed from contacting the paper guides 216 and 221 arranged at the outside of the curved conveying path when a paper is conveyed through the curved conveying path 200, the conveying speed of a paper in the paper converting unit 202 is made slightly faster than the conveying speed of a paper in the printer unit 201 and a paper is conveyed while it is constantly given with a tension.

However, in the apparatus that was disclosed in the above-mentioned Japanese Laid-Open Patent Publication, a tension is always given to a paper being conveyed between two units 201 and 202 and it is therefore considered that there is such a problem that, for example, the surface of the conveying roller 222 of the paper converting unit 202 contacts the surface of a paper and the conveying roller 222 is worn out. Furthermore, there is also such a problem that the leading edge of a paper having an image fixed in the fixing unit 215 is in the free stated until it arrives at the conveying roller 222, and therefore, it tends to contact the paper guides 216 and 221 and may streak on the image printed on the paper.

Further, since a paper passing on the conveying path is always given with a tension, an excessive tensile force is applied to a paper and in the case of a thin and soft paper, the paper can be easily torn out by a slight projection, if any, on the conveying path 200.

BRIEF SUMMARY OF THE INVENTION

The present invention has been made in view of the above-mentioned points and it is an object to provide an image forming apparatus capable of suppressing wear of a paper conveying mechanism and firmly preventing defective image forming caused by the contact of component elements.

According to the present invention, an image forming apparatus is provided. This image forming apparatus comprises: an image forming unit configured to form an image on a first surface of a medium; a guide member that is curved to become convex against the first surface of the medium passed through the image forming unit; a conveying mechanism configured to convey the medium with the image toward a discharge unit by curving the medium along the guide member; and a controller configured to control the conveying speed by the conveying mechanism along the conveying direction of the medium by the conveying mechanism so as to make the conveying speed at the downstream side from the guide member slower than that at the upper stream side from the guide member.

Further, according to the present invention, an image forming method is provided. This image forming method comprises: forming an image on a first surface of a medium; conveying the medium on which the image is formed toward a discharge unit by curving the medium along a guide member that is curved to become convex against the first surface of the medium; and controlling the conveying speed of the medium along the conveying direction so as to make the conveying speed at the downstream side from the guide member slower than that at the upper stream side from the guide member.

DETAILED DESCRIPTION OF THE INVENTION

Preferred embodiments of the present invention will be described below in detail, referring to attached drawings.

Figure 1:
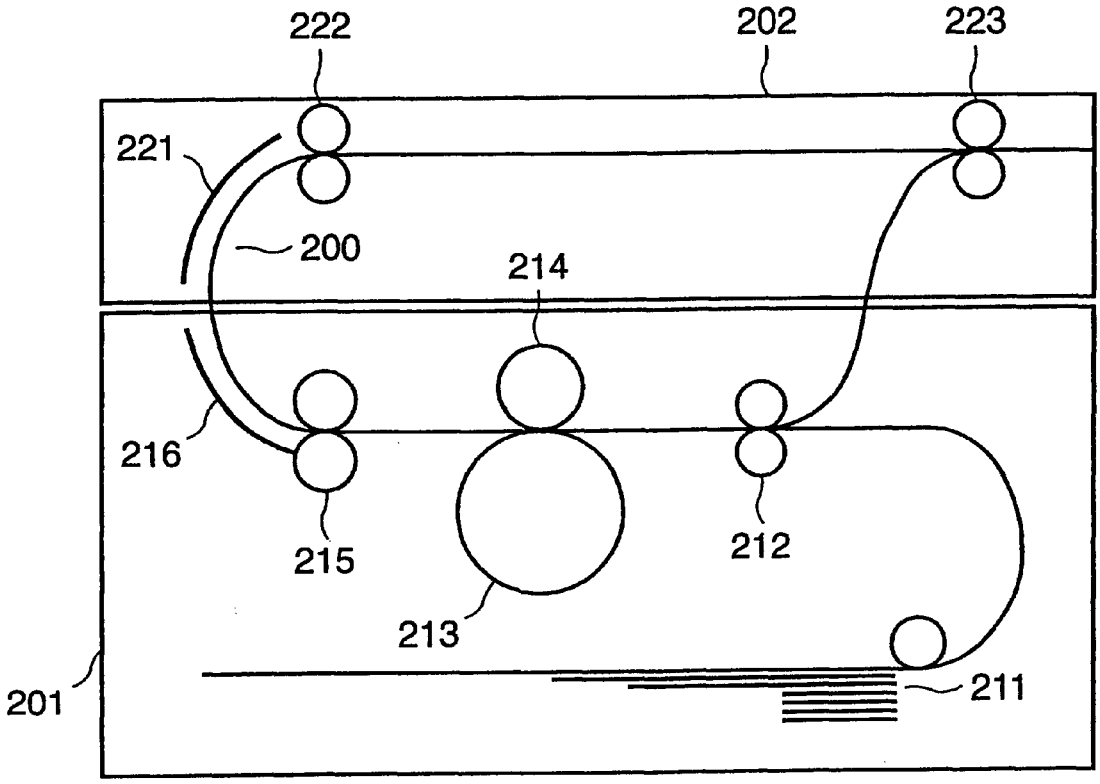
FIG.1 (PRIOR ART)
FIG. 1 is a sectional view showing the brief structure of a conventional image forming apparatus.
Figure 2:
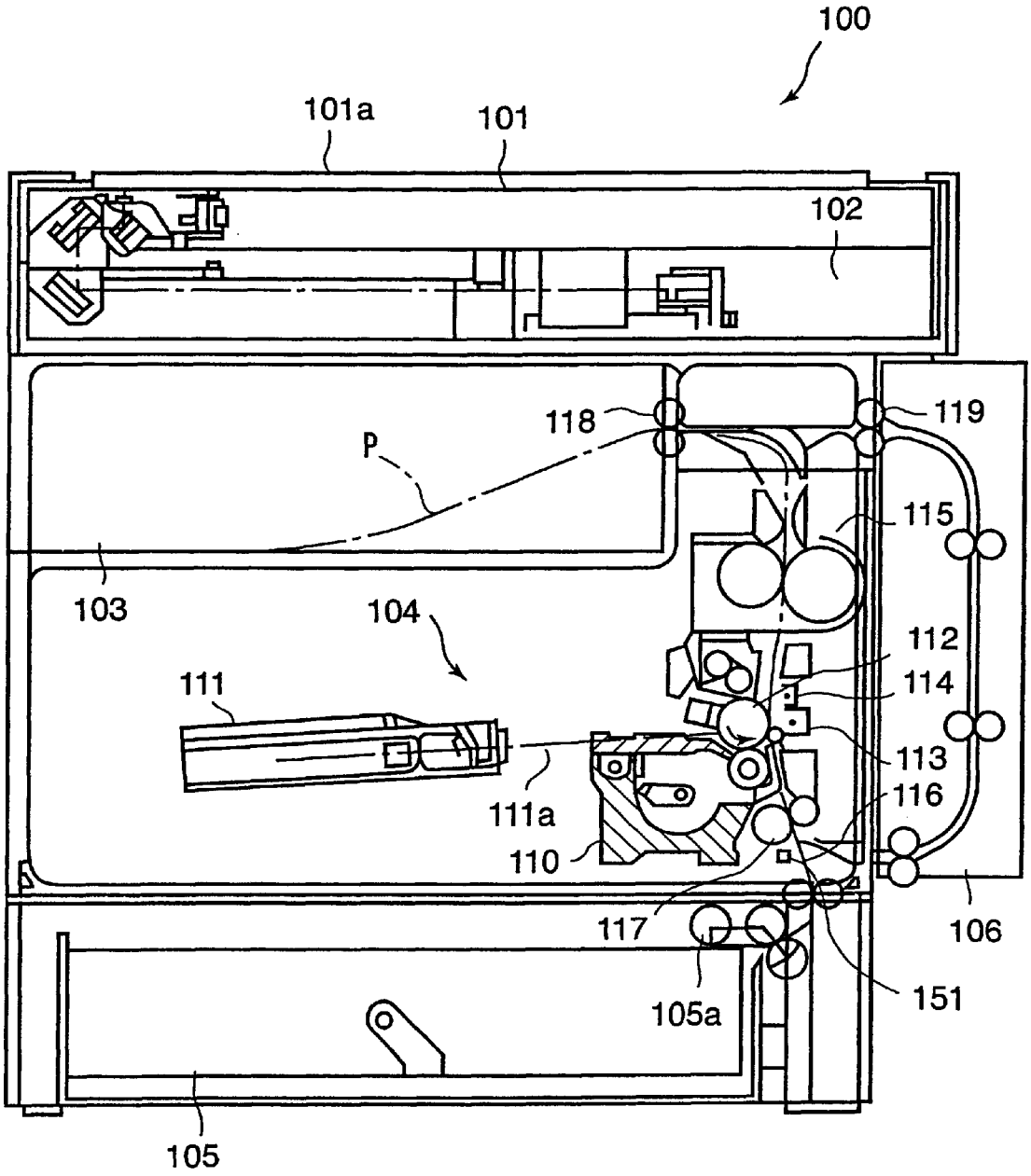
FIG. 2 is a sectional view briefly showing an embodiment of a copying machine as an image forming apparatus of this invention.

FIG. 2 shows the schematic diagram of a digital copier 100 (hereinafter, simply called as a copier 100) involved in a preferred embodiment of this invention viewed from its front side.

The digital copier 100 has a document table 101 on the upper surface for placing documents to be copied. The document table 101 is provided with a cover 101*a* on it. This cover 101*a* can be opened/closed for pressing down documents.

Below the document table 101, there is provided a scanner unit 102 that applies the light to a document set on the document table 101, reads the reflecting light as image data, and generates an image signal based on the read image data.

Below the scanner unit 102, there is provided a paper discharge unit 103 (a discharge portion) to discharge paper with an image formed in the main body.

Below the paper discharge unit 103, there is provided an image forming unit 104 for forming an image based on an image signal generated in the scanner unit 102 or an image signal that is input from an external device (not shown).

Further below the image forming unit 104, there is provided a paper supply cassette 105 containing the plural number of sheets of paper (medium). This paper supply cassette can be inserted/pulled out to/from the front side of the main body of the copying machine.

At the right side of the copying machine 100, a conversion unit 106 is attached to the main body of the copying machine detachable for supplying a paper having an image formed on one side by the image forming unit 104 again thereto by reversing the paper.

The image formation unit 104 comprises an exposure unit 111 that emits a laser beam 111a corresponding to an image signal supplied from the scanner unit 102 or an external device, a photosensitive drum 112 that holds an electrostatic latent image on the surface of the photosensitive drum 112 based on an exposure scanning by the laser beam 111a emitted from the exposure unit 111, and a developing device 110 for develops the electrostatic latent image formed on the surface of the photosensitive drum 112 by supplying a developer to the electrostatic latent image. Further, the image forming unit 104 has a transfer charger 113 for transferring a toner image (a developer image) on the surface of the photo conductor drum developed by development equipment 110 on a paper taken out of the paper supply cassette 105, and a separation charger 114 for separating the paper having the transferred toner image from the surface of the photosensitive drum 112.

On the conveying path of paper passed the separation charger 114, that is, on the upper part of FIG. 2, there is provided a fixing device 115 through which a paper having a toner image that was separated from the surface of the photosensitive drum and transferred on a paper by the separation charger 114 is passed, heated, melted and fixed on the paper.

A digital copier 100 in the above-mentioned structure is of in-body discharge type provided with the paper discharge unit 103 in the main body of the copier. It has the vertical conveyance structure to convey a paper passed through a transferring area between the photosensitive drum 112 and the transfer charger 113 in the vertical direction (the upper part in the figure) toward the fixing device for the convenience of the layout. The paper conveyed in the vertical direction is bent in the leftward by about 90°, and is discharged into the paper discharge unit 103.

Next, the image forming operation by the digital copier 100 in the structure as described above will be explained.

When an image signal is supplied from the scanner unit 102 or an external device, the laser beam 111*a* of which strength is modulated based on this image signal is emitted from the exposure unit 111, and an electrostatic latent image is formed on the surface of the photosensitive drum 112 which is charged to a predetermined potential based on the image signal.

The electrostatic latent image formed on the surface of the photosensitive drum 112 passes through the developing device 110 by the rotation of the photosensitive drum 112. At this time, a toner contained in a developer is supplied to the electrostatic latent image and the latent image is actualized, and a toner image is formed on the surface of the photosensitive drum 112.

Paper stored in the paper supply cassette 105 is taken out by one sheet at a time on the conveying path 116 by a pick-up roller 105*a* provided on the top at one side of the paper supply cassette 105. The leading edge of a paper is once aligned by an aligning roller pair 117 (the conveying mechanism).

The toner image formed on the surface of the photosensitive drum 112 is further conveyed by the rotation of the photosensitive drum 112 and passes through the transfer area where the transfer charger 113 is facing. At this time, the aligning roller pair 117 is rotated at the conveying timing of a toner image and the paper aligned by the aligning roller pair 117 is sent into the transfer area. And a toner image is transferred on the paper passing through the transfer area.

The paper with a toner image transferred is separated from the photosensitive drum 112 by the separation charger 114 and conveyed toward the fixing device 115. When the paper having the transferred toner image passes through the fixing device 115, the toner image transferred on the paper is heated and melted and fixed on the paper, and the image based on the image signal is output on the paper.

The paper with the image output on one side as described above is discharged into the paper discharge unit 103 through a paper discharge roller pair 118 (the conveying mechanism, the discharge roller). At this time, the paper is discharged into the paper discharge unit 103 with the image formed surface (the first surface) downward so that the image cannot be seen.

When it is selected to form an image on the opposite side of the paper, the paper is conveyed to the conversion unit 106 via a conveying roller pair 119. The paper having the image formed on one side conveyed to the conversion unit 106 is sent again into the transfer area through the aligning roller pair 117 and a prescribed image is also formed on the opposite side.

Figure 3:
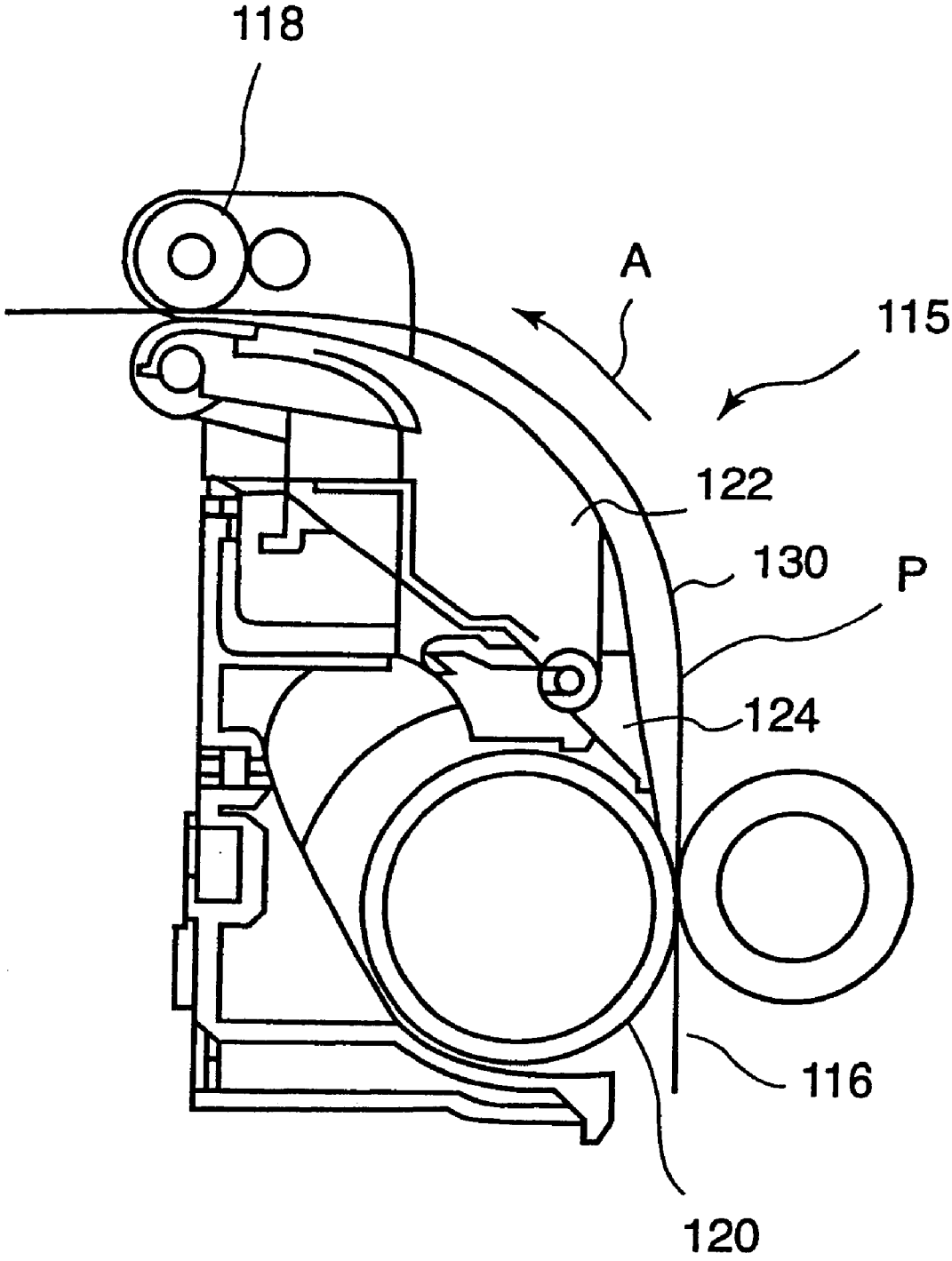
FIG. 3 is an enlarged sectional view of the structure of the principal part of the copying machine shown in FIG. 2.
Figure 4:
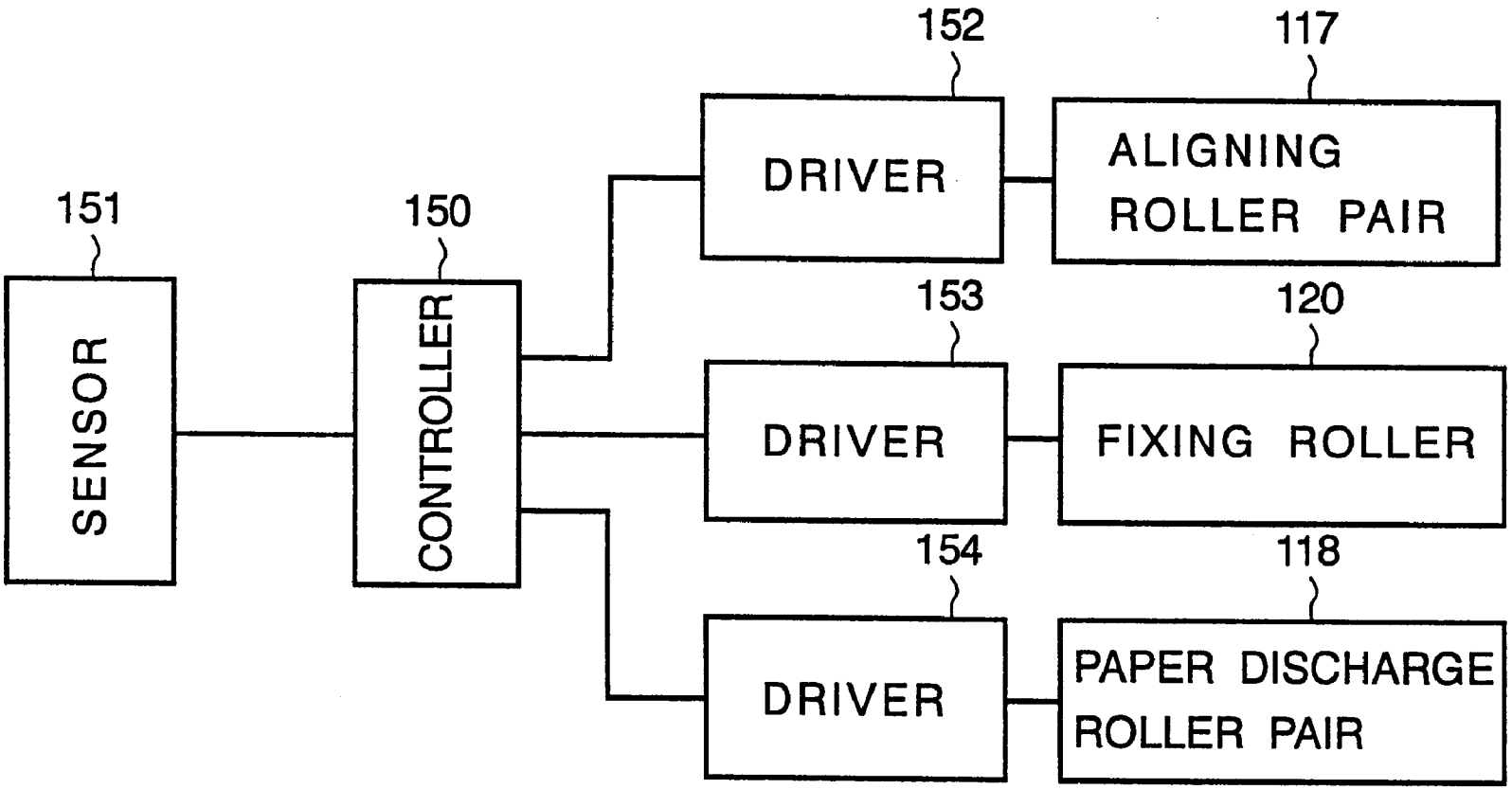
FIG. 4 is a block diagram showing a control system for controlling the operation of the structure shown in FIG. 3.

Next, with reference to FIG. 3 and FIG. 4, the structure and actions of the principal elements of this invention will be explained in detail. FIG. 3 shows the enlarged fixing device 115, paper discharge roller pair 118 and peripheral members. Further, FIG. 4 shows a block diagram of a control system that controls the conveying speed of paper P by the paper discharge roller pair 118.

As shown in FIG. 3, the fixing device 115 has a fixing roller pair 120 which conveys a paper P to the upper part in the figure (the direction of arrow A) by rotating the paper P in the prescribed direction by clamping it from both sides. At least one of the fixing roller pair 120 functions as a heat roller that has a heater inside, and the other is arranged by compressing to this heat roller at a prescribed compression force. The paper P passing through the fixing device 115 passes the nip between the fixing rollers 120 pair and the toner image transferred on the first surface of the paper P (the left side surface in the figure) is heated and compressed against the first surface of the paper P and the toner image is fixed on the first surface of the paper P.

On one side (the left side of the figure) of the conveying path of a paper P toward the paper discharge roller pair 118 at the upper side of the fixing roller pair 120, there is provided a guide member 122 for guiding a paper P passed through the fixing roller pair 120 toward the paper discharge roller pair 118. The guide member 122 is arranged at the inside (the left side in the figure) of a curved conveying path 130 that conveys a paper P in the arrow direction A toward the nip of the paper discharge roller pair 118 from the nip of the fixing roller pair 120 and curved along the conveying path 130. In other words, the guide member 122 is curved in the direction where an image formed on the paper P conveyed through the conveying path 130 becomes convex to the first surface.

At the lower end of the guide member 122 going toward the nip of the fixing roller pair 120, a claw member 124 is mounted rotatably for guiding the leading edge of the paper P passed the nip in the conveying direction to the guide member 122. The claw member 124 is made of an about triangular shape plate member and plural pieces are provided along the direction crossing the conveying direction of the paper P.

As shown in FIG. 4, the digital copier 100 has a controller 150 for controlling the conveying speed of a paper P by the paper discharge roller pair 118. The controller 150 is connected with a sensor 151 provided near the aligning roller pair 117 (FIG. 2) for acquiring the operation timing of the aligning roller pair 117, a driver 152 for rotating and driving the aligning roller pair 117 according to the timing acquired through the sensor 151, a driver 153 for rotating and driving the fixing roller pair 120 at a prescribed speed, that is, the process speed of the digital copier 100, and a driver 154 for rotating and driving the paper discharge roller pair 118 at a variable speed.

The sensor 151 arranged near the aligning roller pair has a light emitting portion and a light receiving portion provided at locations to clamp the conveying path for conveying a paper P, and acquires the operation timing of the aligning roller pair 117 by intercepting the optical axis between the light emitting and receiving portions with the paper P and detects the leading and trailing edges in the conveying direction and the length of the paper P along the conveying direction intercepting the optical axis.

The paper P passed through the transfer area via the aligning roller pair 117 and conveyed into the upper part in the figure is guided by the claw member 124 and conveyed while curved in the leftward in the figure along the guide member 122 after passing the nip of the fixing roller pair 120, passes the nip of the paper discharge roller pair 118 and discharged into the paper discharge unit 103 (FIG. 2).

At this time, as the first surface of the paper P with the image formed is guided by the claw member 124 and the guide member 122 and conveyed through the curved conveying path 130, it is considered that the first surface is brought in contact with the claw member 124 and the guide member 122 and a streak pattern may be formed on the image. Therefore, the conveying speed of a paper P by the paper discharge roller pair 118 to convey by clamping the paper P by is changed at the downstream side from the guide member 122 to slacken it so as to prevent such the problem.

Figure 5:
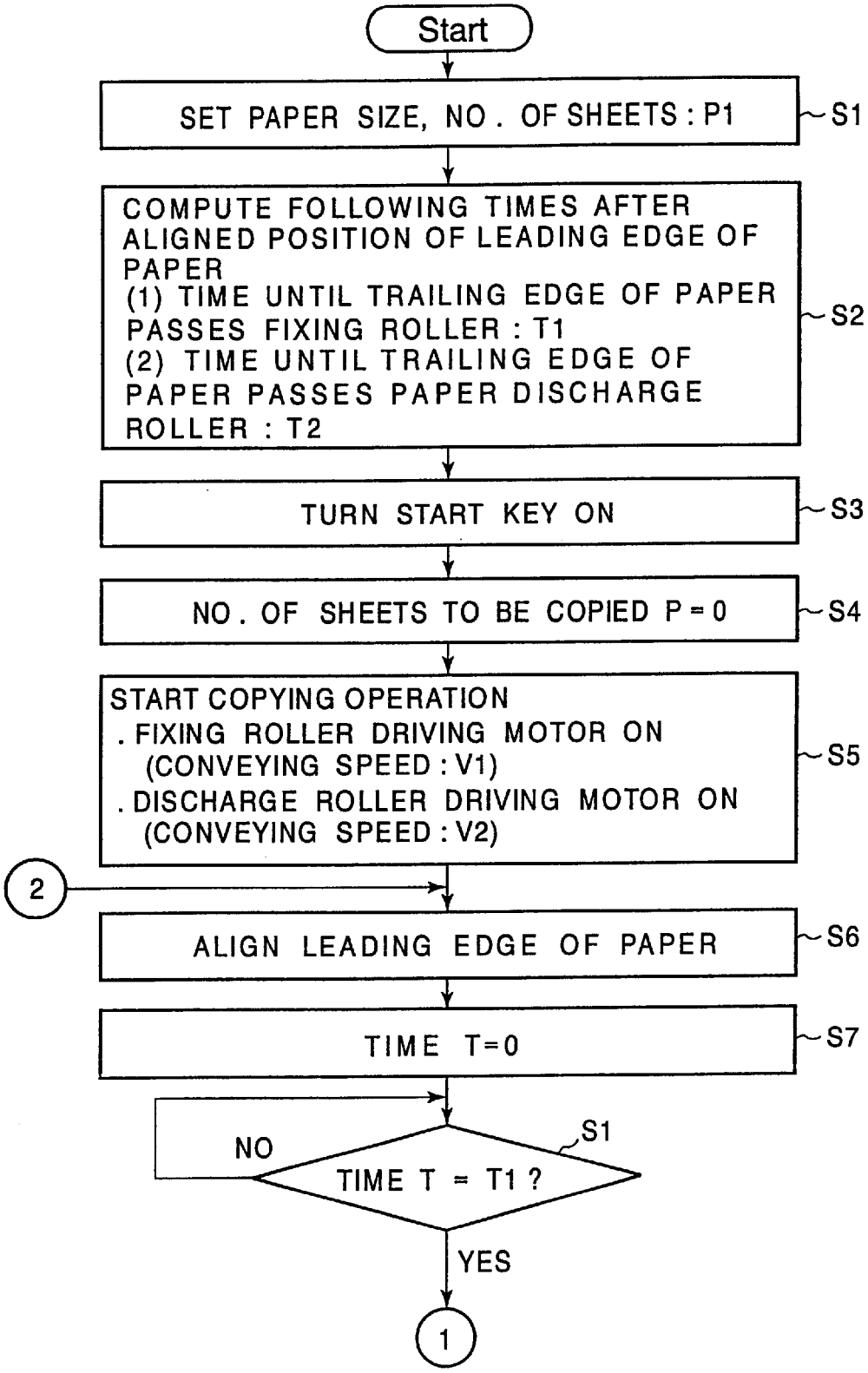
FIG. 5 is a flowchart for explaining the speed control operation by the coping machine shown in FIG. 2.
Figure 6:
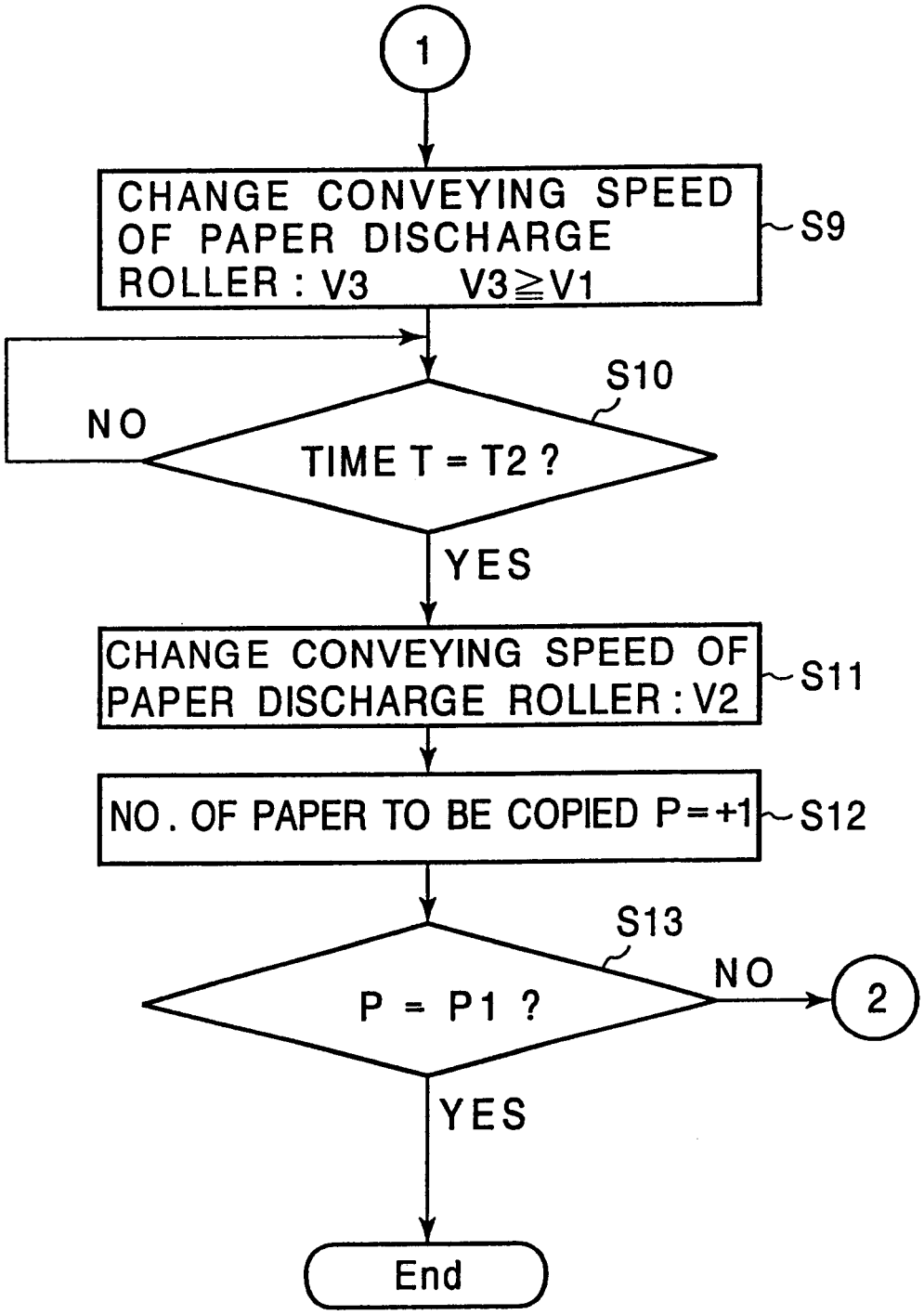
FIG. 6 is a flowchart for explaining the speed control operation by the copying machine shown in FIG. 2.
Figure 7:
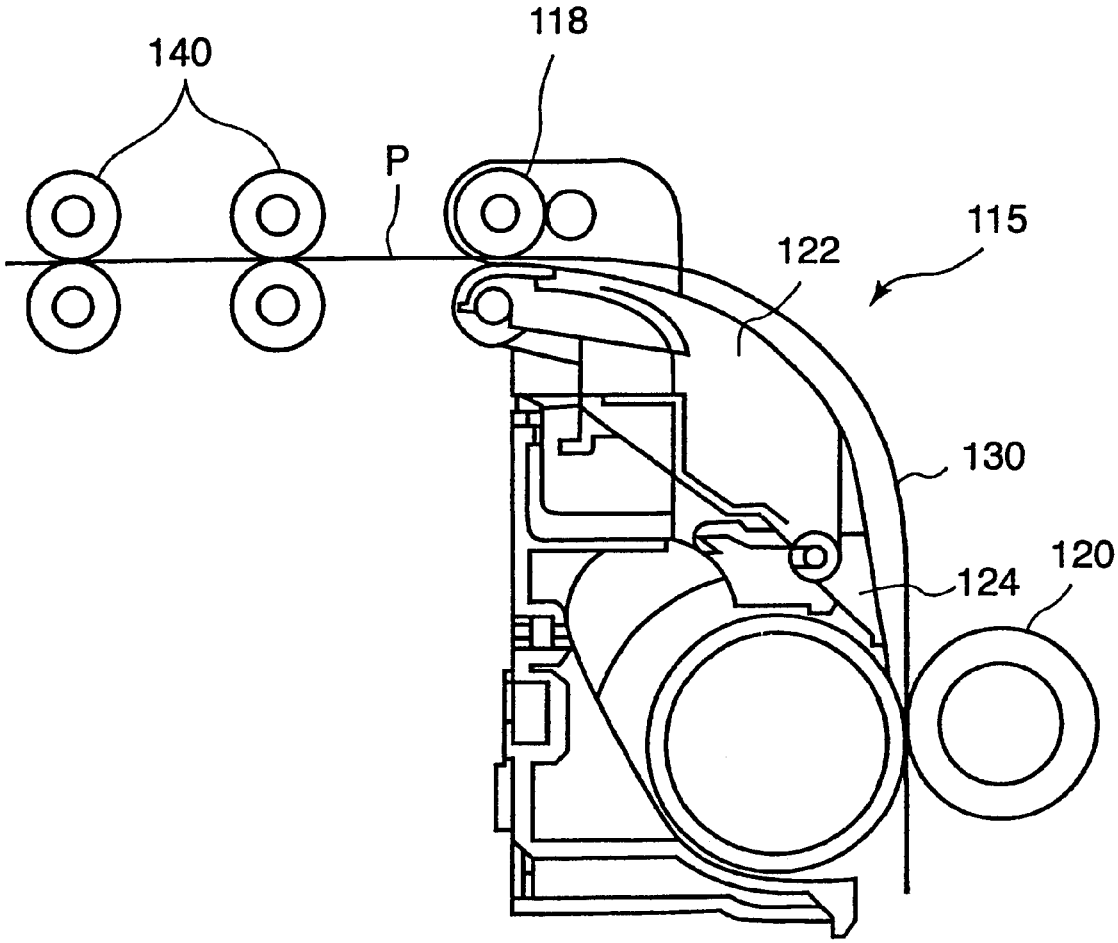
FIG. 7 is a sectional view briefly showing the structure the principal part for sending an exhausted paper to a finisher.

Next, the speed control of the paper discharge roller pair 118 of the present invention will be explained referring to flowcharts shown in FIG. 5 and FIG. 6.

First, a paper size and the number of sheets to be copied P1 is set through the operation panel (not shown) of the digital copier 100 (STEP 1). At this time, based on the paper size set in STEP 1, a time T1 until the paper P completely passes through the fixing roller pair 120 after once aligned by the aligning roller pair 117 and started to be conveyed and a time T2 until the paper P completely passes through the paper discharge roller pair 118 after once aligned by the aligning roller pair 117 and started to be conveyed are computed (STEP 2). These times T1 and T2 are computed based on a distance from the nip of the aligning roller pair 117 to the nip of the fixing roller pair 120 and to the nip of the paper discharge roller pair 118, paper size and processing speed, respectively.

Then, the start key of the operation panel (not shown) is pushed (STEP 3), the number of sheets P=0 is flagged (STEP 4), and the copy operation is started (STEP 5).

When the copy operation is started, the drivers 153 and 154 are controlled as an initializing operation, a motor for rotating the fixing roller pair 120 is turned ON and a motor for rotating the paper discharge roller pair 118 is turned ON. At this time, the conveying speed by the fixing roller pair 120 is set at V1 and the conveying speed by the paper discharge roller pair 118 is set at V2 that is slower than V1 by the paper discharge roller pair 118. In this embodiment, the conveying speed V2 by the paper discharge roller pair 118 was set at the conveying speed slower than that of the fixing roller pair 120 by about 1.5%. That is, the conveying speed V1 by the fixing roller pair 120 is 216.465 mm and the conveying speed V2 by the paper discharge roller pair 118 is 213.18 mm.

That is, (V1−V2)/V1=(216.465−213.465=0.01517 V2 is set at a peed slower than V1 by about 1.5%.

In this state, the prescribed image forming process is executed, and paper P is taken out of the paper supply cassette 105 and the leading edge of the paper P in the conveying direction is once aligned by the nip of the aligning roller pair 117 (step 6).

Then, after a timer (not shown) is reset (Time T=0) (STEP 7), the aligning roller pair 117 is started to rotate at the timing of a toner image formed on the photosensitive drum 112 in the image forming process and a paper P is conveyed into the transferring area.

The paper P passed through the transferring area wherein a toner image is transferred is pressurized and heated when being conveyed while clamped by the fixing roller pair 120 of the fixing device 115. The toner image transferred on the first surface of the paper P is melted and fixed on the first surface and the image is formed thereon. The claw member 124 and the guide member 122 guide the paper P passed through the nip of the fixing roller pair 120 along the curved conveying path 130 to the paper discharge roller pair 118.

At this time, as the conveying speed V2 by the paper discharge roller pair 118 is set at a speed slower than the conveying speed V1 by the fixing roller pair 120 in STEP 5, the middle portion of the paper P of which leading edge in the conveying direction is clamped and delivered to the paper discharge roller pair 118, that is, the middle portion of the paper P between the nip of the fixing roller pair 120 and the nip of the paper discharge roller pair is slackened in the direction separating from the guide member 122. In other words, because the conveying speed V2 at the downstream side from the guide member 122 is slower than the conveying speed at the upper stream side, the middle portion of the paper P that has no place to go due to a difference between both speeds is slackened in the convex direction of the guide member and is separated from the guide member 122. As a result, the first surface of the paper P passing through the curved conveying path 130 is prevented from contacting the claw member 124 and the guide member 122.

The image formed surface of the paper P con be prevented from contacting the curved guide member 122 only by the speed control described above and the defect to form a streak pattern caused from the contact can be prevented. However, when plural conveying roller pairs 140 are provided in the paper discharge unit 103 in order to convey the paper P discharged from the paper discharge roller pair 118 into such a finisher (not shown) as a sorter or a stapler (not shown), a problem can be caused if the conveying speed by the paper discharge roller pair 118 was kept slow. Therefore, in order to avoid such a problem, the speed controls described after STEP 8 and below are executed in this embodiment.

That is, under the condition that the aligning roller pair 117 started to rotate and the time T1 computed in STEP 2 passed (STEP 8: YES), at this timing by judging that the trailing edge of a paper P in the conveying direction to the paper discharge roller pair 118 after passing through the transfer area and the fixing device 115 passed the nip of the fixing roller pair 120, the conveying speed by the paper discharge roller pair 118 is changed to a speed V3 that is equal to or higher than the conveying speed V1 by the fixing roller pair 120, that is, the process speed V1 from the relatively slow conveying speed V2 that was set in STEP 5 (STEP 9). Further, this speed control in STEP 9 is continuously executed until the time T2 computed in STEP 2 is elapsed (STEP 10), that is, until the trailing edge of the paper P passes through the conveying nip of the paper discharge roller pair.

As a result of the speed control in STEP 9, a speed difference is produced between the paper discharge roller pair 118 and a paper P for a relatively short time from the leading edge of a paper P is clamped by plural conveying roller pair 140 arranged in the paper discharge unit 103 after passing the nip of the paper discharge roller pair 119 until the trailing edge of the paper P passes through the nip of the fixing roller pair 120. Accordingly, the influence by the conveyance speed made slow by the paper discharge roller pair 118 can be minimized and the abrasion of the paper discharge roller pair 118 can be suppressed.

After judging the lapse of the time T2 in STEP 10, the conveying speed by 118 is changed from V3 changed in STEP 9 again to the slow speed V2 (STEP 11). Thus, after returning the conveying speed by the paper discharge roller pair 118 to the initial state, the number of sheets flagged in STEP 4 is added (STEP 12), and on condition that this added number of sheets becomes the objective number of sheets set in STEP 1 (STEP 13; YES) and the operation is completed. Further, when it is judged that the objective number of sheets is not reached in STEP 13 (STEP 13: NO), the operation returns to the process of STEP 6 and the image forming process for next paper P is executed.

As described above, according to the present invention, in the image forming apparatus that has the curved conveying path 130 at the downstream side in the conveying direction of a paper P from the fixing device 115 and discharges the paper P with its image formed surface (the first surface) downward so that the image is not seen, the paper P is slackened by varying the conveying speed of the paper P at the upper stream side from that at the downstream side of the curved conveying path 130 so that the first surface of the paper P is prevented from contacting the guide member 122. Thus, such a defect that a streak-like pattern caused by the contact of the paper P with the guide member 122 can be prevented.

Further, the present invention is not restricted to the embodiment described above but can varied variously within the scope of the present invention.

As described above, the image forming apparatus of the present invention has the structure and actions as mentioned above and therefore, is capable of suppressing abrasion of the conveying mechanism and surely preventing the defective image formation resulting from the contact of members without applying an undesirable force to a medium.

What is claimed is:

1. An image forming apparatus comprising:

an image forming unit configured to form an image on a first surface of a medium;

a guide member that is curved to become convex against the first surface of the medium passed through the image forming unit;

a conveying mechanism configured to convey the medium on which the image is formed toward a discharge unit by curving the medium along the guide member, the conveying mechanism including a pair of discharge rollers to discharge the medium to the discharge unit by clamping the medium at the downstream side of the guide member; and a controller configured to control the conveying speed by the conveying mechanism along the conveying direction of the medium by the conveying mechanism so as to make the conveying speed at the downstream side from the guide member slower than that at the upper stream side from the guide member, the controller configured to control the conveying speed of the pair of discharge rollers to a speed slower than a process speed in the image forming unit by about 1.5%.

2. An image forming apparatus comprising:

an image forming unit configured to form a developed image by a developer on a first surface of a medium;

a fixing roller pair configured to convey the medium on which the developed image is formed on the first surface by clamping the medium and fixing the developed image on the first surface by applying pressure while heating the developed image;

a paper discharge unit configured to discharge the medium with the first surface laid down, after the medium has passed through a nip of the fixing roller pair with the developed image fixed on the first surface of the medium;

a guide member curved to become convex against the first surface of the medium passed through the nip of the fixing roller pair and provided to guide the first surface from the nip of the fixing roller pair to the discharge unit;

a paper discharge roller pair provided between the guide member and the paper discharge unit to discharge the medium guided while being curved along the guide member after passing the nip of the fixing roller pair by clamping the medium; and a controller configured to control the conveying speed by the paper discharge roller pair slower than that of the fixing roller pair until a trailing edge in the conveying direction of the medium passed the nip of the fixing roller pair and thereafter, makes the conveying speed by the conveying roller pair fast.

3. The image forming apparatus according to claim 2, wherein the controller makes the conveying speed by the paper discharge roller pair fast up to the same speed as the conveying speed by the fixing roller pair after the trailing edge in the conveying direction of the medium passed the nip of the fixing roller pair.

4. The image forming apparatus according to claim 2, wherein the controller makes the conveying speed by the paper discharge roller pair faster than the conveying speed by the fixing roller pair after the trailing edge in the conveying direction of the medium passed the nip of the fixing roller pair.

5. An image forming method comprising:

forming an image on a first surface of a medium;

conveying the medium on which the image is formed toward a discharge unit by curving the medium along a guide member that is curved to become convex against the first surface of the medium; and controlling the conveying speed of the medium along the conveying direction so as to make the conveying speed at the downstream side from the guide member slower than a process speed in the step for forming the image on the medium by about 1.5%.

* * * * *